United States Patent [19]

Wisniewski

[11] 4,394,001

[45] Jul. 19, 1983

[54] HEIGHT-ADJUSTING MECHANISM FOR CHAIR SEAT

[75] Inventor: Joseph M. Wisniewski, Marne, Mich.

[73] Assignee: Haworth, Inc., Holland, Mich.

[21] Appl. No.: 244,841

[22] Filed: Mar. 18, 1981

[51] Int. Cl.[3] ..... F16M 13/00

[52] U.S. Cl. ..... 248/542; 248/406; 297/345

[58] Field of Search ..... 248/406, 542, 405, 418; 297/345, 349, 298, 301

[56] References Cited

U.S. PATENT DOCUMENTS

| | | | |
|---|---|---|---|
| 3,218,021 | 11/1965 | Michalshi | 248/599 |
| 3,799,486 | 3/1974 | Mohr et al. | 248/406 |
| 3,870,271 | 3/1975 | Bowman | 248/406 |
| 3,991,965 | 11/1976 | Westover et al. | 248/406 |
| 4,026,509 | 5/1977 | Wolters | 248/406 |
| 4,324,382 | 4/1982 | Beukema et al. | 248/406 |

*Primary Examiner*—William E. Lyddane
*Assistant Examiner*—Sarah A. Lechok
*Attorney, Agent, or Firm*—Flynn, Thiel, Boutell & Tanis

[57] ABSTRACT

A threaded spindle as fixed to the chair seat is engaged with a nut positioned within the upper end of the base pedestal. A spring urges the nut for engagement with a clutch plate fixed to the pedestal. This clutch plate holds the nut nonrotatable so that when the chair seat is unoccupied and is rotated, the spindle threads through the nut so as to adjust the height of the chair seat. The nut and clutch plate have opposed engageable cam portions which effect automatic disengagement therebetween if the engaged nut and clutch plate are subjected to excessive torsional resistance. When the chair seat is occupied, the nut moves downwardly away from the clutch plate into engagement with a clutch washer which is seated on the pedestal but is nonrotatably keyed to the spindle, whereby the chair seat and the accompanying spindle and nut can freely rotate without causing a height adjustment to occur. A tube is positioned in surrounding relationship to the spindle and its lower end bears on the nut. When the chair seat is adjusted into its lowermost height position, an abutment on the chair seat engages the upper end of the tube.

10 Claims, 4 Drawing Figures

HEIGHT-ADJUSTING MECHANISM FOR CHAIR SEAT

FIELD OF THE INVENTION

This invention relates to a spindle-type support for a chair of the swivel or pivotal type and, in particular, to an improved load-released height-adjusting mechanism as associated with the support.

BACKGROUND OF THE INVENTION

Height-adjusting mechanisms of the aforesaid type, wherein the height of the chair seat is adjusted by rotation of the chair seat when unoccupied, with the adjusting mechanism being disengaged when the chair seat is occupied, are well known and such mechanisms are widely used on spindle-type office chairs. In mechanisms of this general type, the spindle is threadably engaged with a nut which can be suitably held in nonrotatable relationship relative to either the base or the chair seat so as to define adjusting and nonadjusting positions. A spring normally urges the chair seat slightly upwardly when it is unoccupied so that the nut is nonrotatably connected to the base, whereby rotation of the seat causes the spindle to threadably move through the nut and hence cause a height adjustment of the seat. Conversely, when the chair seat is occupied, the external force imposed on the chair seat overcomes the spring and moves the chair seat and spindle downwardly a limited amount so that the nut is nonrotatably engaged with the spindle, whereby swivelling or rotating the occupied chair seat does not change its height. Height-adjusting mechanisms of the above type are illustrated by U.S. Pat. Nos. 3,870,271 and 3,991,965.

While these known height-adjusting mechanisms do perform in a generally satisfactory manner relative to the normal height adjustment throughout the selected adjustment range, nevertheless these mechanisms have been unsatisfactory when the unoccupied chair seat reaches the extreme limits of its height-adjustment range, such as when the unoccupied chair seat reaches its lowermost adjusted position. In these known mechanisms, when the seat is unoccupied, the nut is non-rotatably locked by its engagement with stops which are fixed to the base. Thus, when the chair seat is rotationally adjusted into its lowermost height position, any attempt to continue the rotation of the chair seat causes the nut and spindle to be tightly wedged together so that not only is further rotation of the chair seat impossible, but rotational release of the chair seat is difficult and the height-adjusting mechanism can be damaged.

Another disadvantage associated with the known height-adjusting mechanism, specifically those illustrated by the aforesaid patients, is the manner in which the spring is captivated within the mechanism. Specifically, the spring in the aforesaid mechanisms is captivated below the nut in such a manner that it is compressed into a solid height condition when the chair is adjusted into its lowermost height position, or in the alternative the spring is formed as resilient washers which continuously urge the spindle-mounted clutch washer against the nut so that during height-adjusting rotation of the unoccupied chair seat a continuous engagement-disengagement action occurs between the nut and clutch washer which not only increases the wear of these elements but also creates undesired resistance to rotation and an undesired clicking noise.

Still another disadvantage of known mechanisms is their mechanical complexity and bulkiness, and particularly their inability to be efficiently and compactly contained within the base pedestal.

Other examples of known height-adjusting mechanisms for chairs are disclosed in U.S. Pat. Nos. 4,026,509, 3,799,486, 3,218,021 and 2,702,075.

Accordingly, the present invention relates to an improved height-adjusting mechanism for a chair, namely a height-adjusting mechanism of the general type described above in that it permits a height-adjusting function to occur solely by rotation of the chair seat when the latter is unoccupied, which improved mechanism overcomes the above-mentioned disadvantages. In this invention, when the chair seat is adjusted into its uppermost or lowermost height positions, the mechanism still permits the chair seat to freely rotate or swivel.

In the improved height-adjusting mechanism of this invention, the threaded spindle as fixed to the chair seat is threadably engaged with a nut which is positioned adjacent and within a bore formed in the upper end of the base pedestal. A spring coacts between the base and nut and urges the nut, and hence the chair seat, upwardly whereby the nut is engaged with a clutch plate fixed to the pedestal. This clutch plate holds the nut nonrotatable so that when the chair seat is unoccupied and is rotated, the spindle threads upwardly or downwardly through the nut dependent upon the direction of rotation so as to adjust the height of the chair seat. The nut and clutch plate have opposed engageable cam portions which effect automatic disengagement therebetween if the engaged nut and clutch plate are subjected to an excessive torsional resistance. When the chair seat is occupied, the weight of same moves the nut downwardly away from the clutch plate into engagement with a clutch washer which is seated on the pedestal but is nonrotatably keyed to the spindle, whereby the chair seat and the accompanying spindle and nut can freely rotate or swivel as desired without causing a height adjustment to occur. The spindle has a limit structure associated therewith for defining the lowermost height position of the chair seat. This limit structure, in a preferred embodiment, comprises a tube of preselected length positioned in surrounding relationship to the spindle and having its lower end bearing on the nut, and its upper end positioned in close proximity to the underside of the chair seat. When the chair seat is adjusted into its lowermost height position, an abutment on the chair seat engages the upper end of the limit tube so that a reaction force is transmitted through the tube onto the nut, thereby preventing further rotation between the nut and spindle. If the chair seat is then rotated an additional amount in a direction tending to cause a downward adjustment, the opposed cam portions automatically cam the nut downwardly so that it disengages the clutch plate, thereby preventing any further lowering of the chair seat while at the same time permitting the chair seat to freely rotate to prevent binding between the spindle and nut. As the nut rotates, it revolves on the clutch plate so that the cams make a clicking sound which thus indicates that the chair seat is at its lowest position.

Other objects and purposes of the invention will be apparent upon reading the following specification and inspecting the accompanying drawings.

Figure 1:
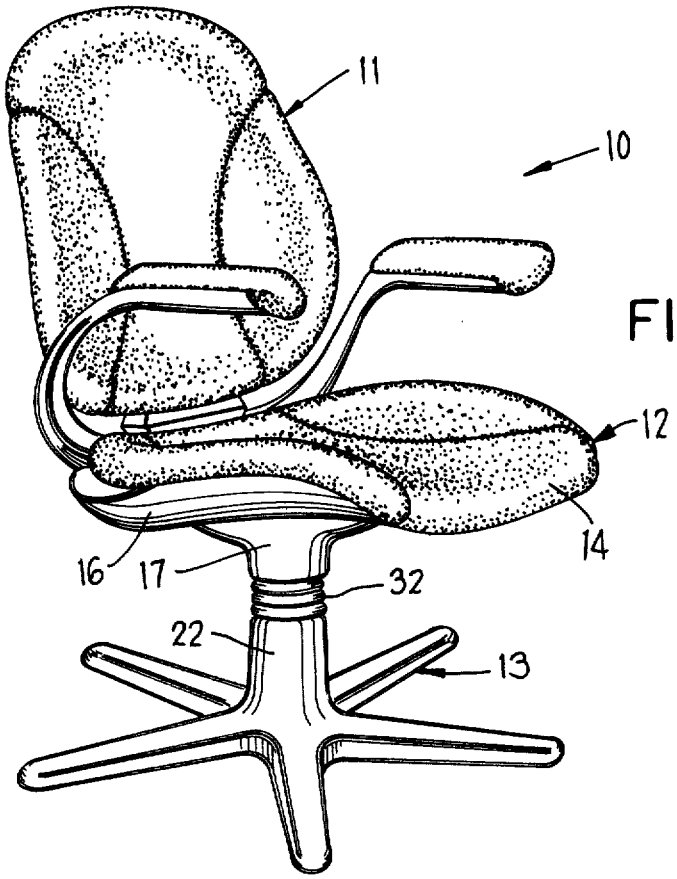
FIG. 1 is a perspective view of a swivel-type chair employing therein the height-adjusting mechanism of this invention.

Certain terminology will be used in the following description for convenience in reference only, and will not be limiting. For example, the words "upwardly", "downwardly", "rightwardly" and "leftwardly" will refer to directions in the drawings to which reference is made. The words "upwardly" and "downwardly" will also refer to the direction of movement of the chair seat responsive to the height adjustment thereof. The words "inwardly" and "outwardly" will refer to directions toward and away from, respectively, the geometric center of the chair and designated parts thereof. Said terminology will include the words specifically mentioned, derivatives thereof, and words of similar import.

DETAILED DESCRIPTION

Figure 2:
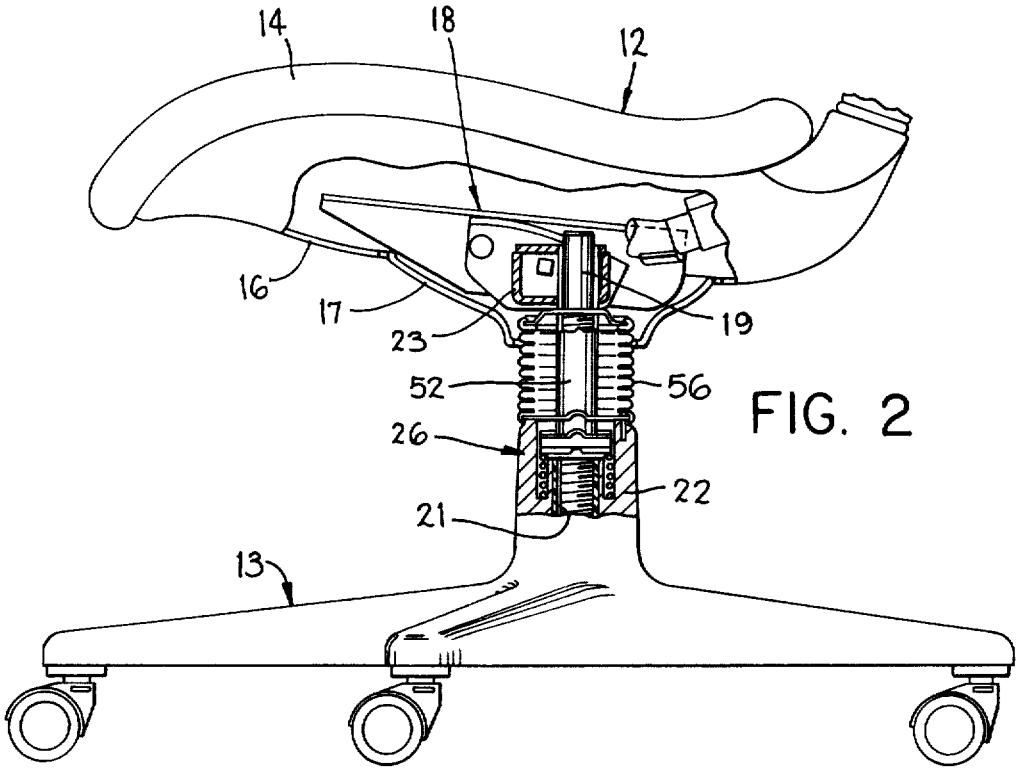
FIG. 2 is a fragmentary elevational view, partially in cross section, illustrating the spindle assembly, including the height-adjusting mechanism, used for joining the seat assembly and base.
Figure 4:
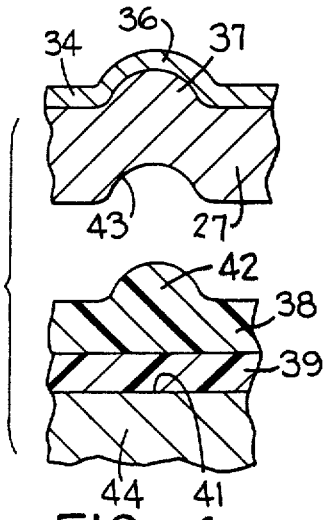
FIG. 4 is an enlarged, fragmentary, sectional view along line IV—IV in FIG. 3.

FIG. 1 illustrates an office-type chair 10 having a back assembly 11, a seat assembly 12 and a pedestal-type base 13. The seat assembly 12, as illustrated by FIG. 2, includes a seat cushion 14 supported by an outer or lower shell 16, the latter having a funnel-like shroud 17 fixed thereto. A conventional chair control 18, examples of which are illustrated by U.S. Pat. Nos. 4,099,774 and 4,067,610, is disposed within the seat assembly.

The seat assembly 12 and base 13 are joined together by a spindle assembly which includes an elongated upright spindle 19 which has its upper end nonrotatably fixed to the seat assembly 12, as by being fixed to the frame elements 23 associated with the chair control 18, such as is conventional. The spindle 19 projects downwardly from the seat assembly and extends into a central opening 21 which extends through the column or pedestal 22 as associated with the base 13.

The spindle 19 and pedestal 22 are suitably joined together by a height-adjusting mechanism 26 which not only permits swivelling of the seat assembly about the longitudinal or vertical axis of the spindle, but also enables the height of the seat assembly to be adjusted upwardly or downwardly in response to rotation of the seat assembly relative to the base when the chair seat is unoccupied.

Figure 3:
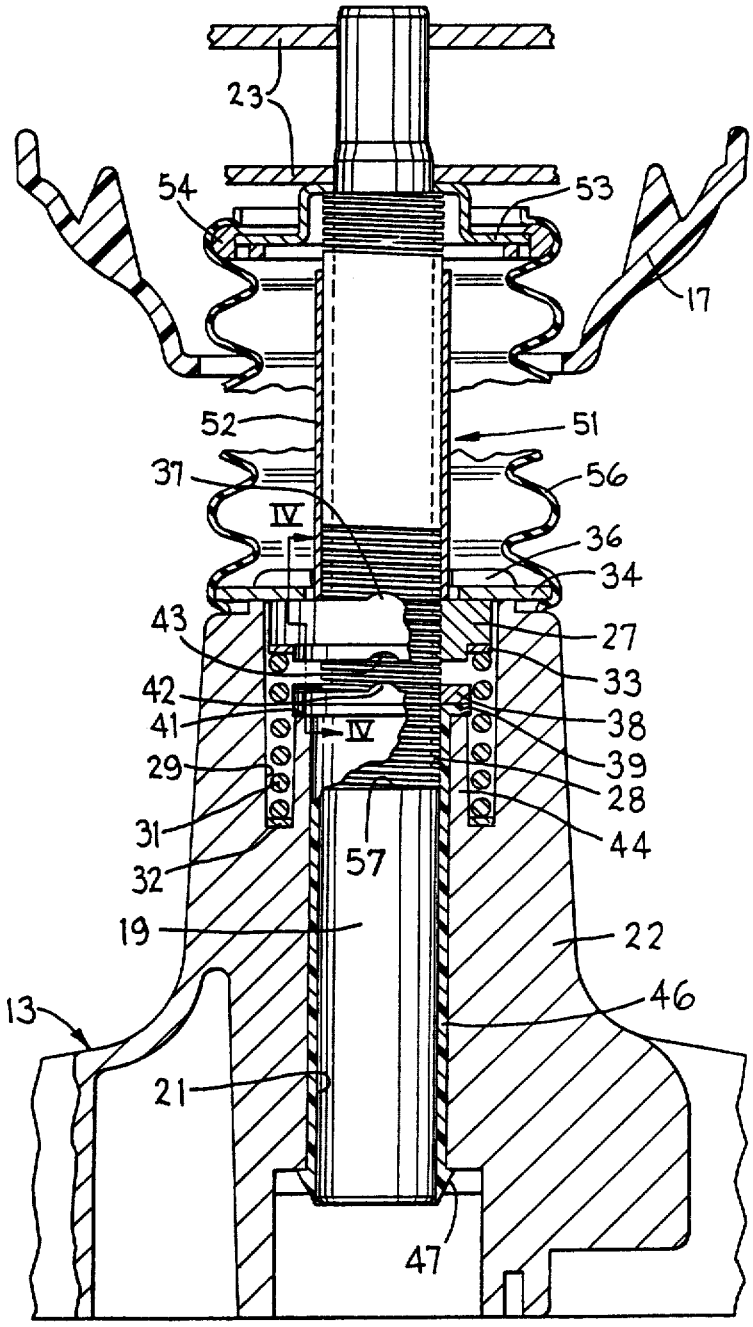
FIG. 3 is an enlarged, fragmentary, sectional view illustrating the height-adjusting mechanism as associated with the spindle assembly, which mechanism is illustrated in its engaged or height-adjusting position.

As shown in FIG. 3, this height-adjusting mechanism 26 includes a nut 27 which is threadably engaged with a threaded portion 28 of the spindle 19. This nut 27 is positioned within an enlarged bore or opening 29 which is formed in the upper end of the pedestal 22 in surrounding relationship to the central opening 21. A spring 31, such as a coil-type compression spring, is seated within this bore 29. The lower end of spring 31 bears on an annular washer 32 which in turn is seated on an annular surface formed on the pedestal. The upper end of spring 31 bears against a further annular washer 33, which in turn bears against the underside of nut 27 so that the nut is hence urged upwardly into engagement with an annular clutch plate 34 which is fixedly secured to the upper end of the pedestal, as by means of screws (not shown).

The annular clutch plate 34 has several, here four, cam recesses or grooves 36 formed therein in equally angularly spaced relationship. These recesses 36 are formed by portions of the clutch plate being physically axially deformed. These recesses 36 have a rounded configuration when viewed in cross section. The upper axial end of nut 27 has several, here four, cams or ridges 37 formed thereon and projecting axially upwardly therefrom. These cams 37 have a rounded configuration and are adapted to project into and closely occupy the recesses 36 formed in the clutch plate 34. With the cams 37 engaged within the recesses 36, the nut 27 is nonrotatably connected to the clutch plate 34, and hence is nonrotatably held relative to the pedestal 22.

Positioned below the nut 27 is a clutch-type annular bearing washer 38 which is nonrotatably connected to but axially slidable relative to the spindle 19. This clutch washer 38 has a radially inwardly-projecting tab (not shown) which is slidably engaged within an axially elongated keyway (not shown) formed in the spindle 19, such as is conventional, so as to nonrotatably connect the clutch washer to the spindle but permit the spindle to axially move relative thereto. This clutch washer 38 is rotatably seated on an annular bearing flange 39, the latter in turn being seated on an annular shoulder 41 as defined on the pedestal 22. This shoulder 41 is at the upper end of a tubular pedestal portion 44 which concentrically separates the central opening 21 from the spring-retaining bore 29, so that the shoulder 41 is hence disposed substantially above the lower end of the spring.

The clutch washer 38 has several, here four, clutch projections 42 provided thereon and spaced equally angularly therearound. These clutch projections 42 project axially upwardly from the upper surface of the washer, and are designed to project into similar rounded recesses 43 as formed in the lower axial end surface of the nut 27.

As illustrated in FIG. 3, the annular clutch plate 34 and clutch washer 38 are disposed on opposite axial sides of the nut 27 and are axially spaced apart by a distance which exceeds the axial dimension of the nut, which axial spacing normally exceeds the axial nut dimension by a distance in the range of three-eighths to three-fourths inch. Hence, the spring 31 normally urges the nut 27 and the associated spindle 19 and seat assembly 12 upwardly so that the nut is nonrotatably clutched to the clutch plate 34. When the seat assembly 12 and spindle 19 are moved downwardly against the urging of spring 31, the nut 27 engages the clutch washer 38 which prevents any further downward movement of the seat assembly and nonrotatably couples the nut to the spindle 19 so that it rotates therewith as a unit. This latter position is assumed when the chair seat is occupied.

To assist in rotatably supporting the spindle 19 within the pedestal 22, the pedestal mounts thereon a one-piece sleeve bearing 46 which is snugly disposed within and effectively lines the central opening 21. This sleeve bearing 46 is preferably constructed of a low-friction plastic material, and the aforesaid annular bearing flange 39 is integrally connected to the upper end of the bearing 46. The bearing 46 preferably has two or more slits formed therein and extending upwardly from the lower end, thereby permitting the lower end to by resiliently deformed. The lower end has camming tabs 47 which will cam inwardly to enable the sleeve bearing to be slid downwardly through the pedestal, whereupon the tabs 47 snap outwardly below a shoulder formed at the lower end of the pedestal to thereby lock the sleeve bearing in position.

The height-adjusting mechanism of this invention also includes a lower-limit means 51 for defining the lowermost adjusted height position of the chair. This limit means 51, in the illustrated embodiment, comprises an elongated rigid sleeve or tube 52 of preselected length, which tube 52 is disposed in surrounding relationship to the spindle 19 and is positioned axially between the nut 27 and the underside of the chair seat. This tube 52 closely surrounds but is freely rotatable relative to the spindle, and the lower end of the tube rests on the upper surface of the nut 27. The upper end of tube 52 is normally spaced downwardly from an annular plate 53, the latter being fixed to the spindle 19 in close proximity to the seat assembly. This plate 53 is adapted to abut the upper end of tube 52 when the seat assembly is adjustably moved into its lowermost height position, so that the tube 52 will then react directly against the nut 27 to prevent further relative rotation between the spindle and nut.

As illustrated, the exposed portions of spindle 19 and tube 52 are enclosed by a flexible boot or bellows 56 which extends between the chair seat and the upper end of the pedestal. As illustrated, the lower end of the bellows is anchored by having the lower convolution positioned so as to surround the outer edge of the annular clutch plate 34. The upper end of the bellows is supported by a bearing ring 54 which is rotatably mounted on the plate 53.

OPERATION

The operation of the height-adjusting mechanism, as briefly described, results in the unoccupied chair seat being urged upwardly by spring 31 so that nut 27 is clutchably engaged with annular clutch plate 34, the nut being held stationary so that rotation of the chair seat and spindle causes the latter to be threaded upwardly or downwardly, depending on the direction of rotation, to thereby adjust the height of the chair seat. When the chair seat is occupied, the weight imposed thereon causes the chair seat and spindle to be moved downwardly against the opposition of spring 31 until the nut bears on the clutch washer 38. This results in the nut 27 being nonrotatably clutched to the washer 38 which, being nonrotatably coupled to the spindle 19, hence permits the chair seat to be rotated or swivelled during normal usage without affecting the height adjustment.

When the chair seat is unoccupied and the seat is rotated so as to cause it to be moved into its lowermost position, then when the chair seat approaches its lowermost position, the mounting plate 53 fixed to the spindle engages the upper end of the tube 52, whereupon further rotation of the chair seat in the same direction then results in the tube 52 reacting against the nut so that it tends to rotate with the spindle. This causes the cams 37 to react against the recesses 36 so as to force the nut 27 axially downwardly out of engagement with the annular clutch plate 34. The nut and spindle will then synchronously freely rotate while preventing any further lowering of the chair seat. In this manner the lowermost height position of the chair seat is readily defined without causing any binding or locking-up of the height-adjusting mechanism. During this latter rotation, the cams 37 on nut 27 will rub against the cam plate 34 and will create a clicking noise as they pass over the recesses 36, thereby signaling that the chair seat is in its lowermost height position.

When the chair seat is adjusted into its uppermost height position, which is defined by the lower axial end of the nut abutting a shoulder 57 defined on the spindle at the lower end of the threaded portion, then continued rotation of the chair seat will also cause the cams 37 on the nut 27 to cam out of the recesses 36 in the annular clutch plate 34, and hence further rotation will again cause a clicking sound which occurs as the cams on the nut pass over the recesses on the clutch plate, so as to indicate to the user that the chair is in its uppermost height position.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a chair having a seat means, a base having thereon an upwardly-projecting pedestal defining a central opening which projects vertically downwardly therethrough, a vertically-elongated spindle having the upper end portion thereof nonrotatably secured to said seat means, said spindle projecting downwardly so that the lower portion thereof is rotatably positioned and confined within said central opening, said spindle having an elongated central portion thereof provided with external threads, and a load-released height-adjusting mechanism coacting between said spindle and said pedestal for (1) rotatably supporting the seat means when occupied for rotation about the axis of the spindle and (2) permitting the height of said seat means when unoccupied to be vertically adjusted responsive to rotation of the unoccupied seat means relative to the base, said height-adjusting means including a nut threadably engaged with said spindle, a first clutch means for nonrotatably connecting said nut to said spindle when said seat means is occupied, a second clutch means for nonrotatably connecting said nut to said pedestal when said seat means is unoccupied, and spring means normally urging said nut upwardly relative to said pedestal for effecting engagement of said second clutch means when the seat means is unoccupied, the improvement comprising: an enlarged bore formed in said pedestal and projecting downwardly from the upper end thereof in concentric relationship to said central opening, said second clutch means being mounted adjacent the upper end of said pedestal, said first clutch means being positioned within said bore downwardly a substantial distance below said second clutch means, said nut being disposed vertically between said first and second clutch means, said second clutch means includinng a second clutch element fixed to said pedestal adjacent the upper end thereof and disposed for engagement with an opposed upper clutch portion formed on the upper end of said nut when said nut is in a raised position due to said seat means being unoccupied, said first clutch means including a first clutch element which is axially seated on a shoulder formed on said pedestal in axially downwardly spaced relationship from the upper end of said pedestal, said first clutch element being nonrotatably but axially slidably connected to said spindle and being engageable with an opposed lower clutch portion formed on the lower end of said nut when the latter is in its lower position due to said seat means being occupied, and said spring means comprising a coil spring concentrically disposed within said bore and having the lower end thereof seated on said pedestal and the upper end thereof disposed in operative engagement with said nut for continuously urging the latter upwardly toward said second clutch element, said coil spring being disposed in encircling relationship to said first clutch element, whereby said nut is totally disengaged and is spaced axially upwardly from said first clutch element when in said upper position.

2. A chair according to claim 1, wherein said second clutch element comprises an annular clutch plate fixed to said pedestal adjacent the upper end thereof and disposed in encircling relationship to said spindle, said second clutch element and said upper clutch portion as formed on said nut having axially interfitting cam-type clutch portions which permit the nut to be non-rotatably coupled to the second clutch element but which automatically cam the nut axially downwardly into a released position in response to continued rotation of said unoccupied seat means when the latter reaches its lowermost or uppermost adjusted height position.

3. A chair according to claim 1, including height-limiting means coacting between said spindle and said nut for defining the lowermost adjusted height position of said seat means when the latter is unoccupied, said limiting means comprising an elongated tubular element disposed in loose surrounding relationship to said spindle, said tubular element having the lower end thereof bearing on the upper end of said nut, the upper end of said tubular element being disposed in axial abutting engagement with a shoulder on said spindle only when the seat means is in its lowermost adjusted height position.

4. A chair according to claim 3, wherein said shoulder on said spindle comprises an annular platelike washer which is fixed to said spindle adjacent the upper end thereof, and an elongated flexible tubular boot positioned in surrounding relationship to said spindle and said tubular element for enclosing same, said tubular boot having the upper end thereof mounted on said platelike washer, and the lower end of said boot being connected to the upper end of said pedestal.

5. A chair according to any one of claims 1–4, wherein said pedestal includes an intermediate annular wall which projects axially upwardly from the bottom wall of said bore and divides said bore from said central opening, said coil spring being disposed in external surrounding relationship to said intermediate annular wall, said intermediate annular wall having an annular shoulder defined at the upper end thereof which is spaced downwardly from the upper end of said pedestal, said annular shoulder functioning as a seat for supporting thereon said first clutch element.

6. A chair according to claims 1–4, wherein said nut is clutchably and nonrotatably engaged with said second clutch element when said unoccupied seat means is rotated so as to selectively adjust the height of said seat means, said nut being wholly disengaged from said first clutch element during the height-adjusting operation so that said height-adjusting operation is substantially noiseless, and said nut being cammed downwardly from said second clutch element so as to permit rotation of said nut along with the spindle and the unoccupied seat means when the latter reaches its lowermost adjusted height position so that the nut rotates around but is in abutting engagement with the second clutch element to create an audible clicking signal.

7. In a chair having a seat means, a base having thereon an upwardly-projecting pedestal defining a central opening which projects vertically downwardly thereof, a vertically elongated spindle which is at least partially externally threaded and has the upper end portion thereof nonrotatably connected to said seat means, the lower portion of said spindle being rotatably supported within the central opening of said pedestal, and a load-released height-adjusting mechanism coacting between said spindle and said pedestal for permitting the seat means and spindle to be vertically displaced a preselected distance between a raised position when the seat means is unoccupied and a lowered position when the seat means is occupied, said height-adjusting mechanism permitting free rotation of the seat means when the latter is occupied and is in said lowered position, said height-adjusting mechanism permitting the height of said seat means to be vertically adjusted relative to the pedestal when the seat means is in said raised position and the unoccupied seat means is rotated relative to said pedestal, said height-adjusting mechanism including a nut threadably engaged with said spindle and spring-urged upwardly toward said raised position, said height-adjusting mechanism also including a first clutch device for nonrotatably connecting the nut to the spindle when in said lowered position and a second clutch device for nonrotatably connecting the nut to the pedestal when in said raised position, the improvement wherein said nut is wholly disengaged from said first clutch device when the nut is engaged with said second clutch device, and wherein said second clutch device and said nut have opposed cam means for automatically axially displacing said nut means into a disengaged position due to continued rotation of said seat means together with simultaneous rotation of said spindle and nut after said seat means has been adjustably moved into its lowermost height position.

8. A chair according to claim 7, including limit means coacting between said spindle and said nut when the nut is in said raised position for preventing relative rotation between said spindle and said nut when said seat means has been rotatably adjusted into its lowermost height position, whereby the continued rotation of said seat means causes the nut to be cammingly disengaged from said second clutch device, said limit means comprising an axially elongated tubular member positioned above said nut in loose surrounding relationship to said spindle, the lower end of said tubular member being positioned for engagement with said nut, and abutment means fixed to said seat means or said spindle and disposed for abutting engagement with the upper end of said tubular member when the seat means reaches its lowermost height position.

9. A chair according to claim 2, including height-limiting means coacting between said spindle and said nut for defining the lowermost adjusted height position of said seat means when the latter is unoccupied, said limiting means comprising an elongated tubular element disposed in loose surrounding relationship to said spindle, said tubular element having the lower end thereof bearing on the upper end of said nut, the upper end of said tubular element being disposed in axial abutting engagement with a shoulder on said spindle only when the seat means is in its lowermost adjusted height position.

10. A chair according to claim 5, wherein said nut is clutchably and nonrotatably engaged with said second clutch element when said unoccupied seat means is rotated so as to selectively adjust the height of said seat means, said nut being wholly disengaged from said first clutch element during the height-adjusting operation so that said height-adjusting operation is substantially noiseless, and said nut being cammed downwardly from said second clutch element so as to permit rotation of said nut along with the spindle and the unoccupied seat means when the latter reaches its lowermost adjusted height position so that the nut rotates around but is in abutting engagement with the second clutch element to create an audible clicking signal.

* * * * *